US005322189A

United States Patent [19]

Oda

[11] Patent Number: 5,322,189

[45] Date of Patent: Jun. 21, 1994

[54] FASTENER FEEDING MECHANISM IN FASTENER DRIVING DEVICE

[75] Inventor: Jiro Oda, Anjo, Japan

[73] Assignee: Makita Corporation, Anjo, Japan

[21] Appl. No.: 896,985

[22] Filed: Jun. 11, 1992

[30] Foreign Application Priority Data

Jun. 12, 1991 [JP] Japan ..... 3-140096

[51] Int. Cl.[5] ..... B65H 1/08

[52] U.S. Cl. ..... 221/227; 221/238; 227/120

[58] Field of Search ..... 227/120, 125, 126, 130, 227/135, 136; 221/227, 236, 238, 243

[56] References Cited

U.S. PATENT DOCUMENTS

| | | | |
|---|---|---|---|
| 3,174,672 | 3/1965 | Juilfs | 227/120 |
| 3,826,419 | 7/1974 | Maestri | 227/136 |
| 4,558,811 | 12/1985 | Klaus | 227/126 |
| 4,767,043 | 8/1988 | Canlas, Jr. | 227/130 |
| 5,083,694 | 1/1992 | Lemos | 227/130 |
| 5,163,596 | 11/1992 | Ravod et al. | 227/120 |

FOREIGN PATENT DOCUMENTS

| | | |
|---|---|---|
| 55-528455 | 7/1980 | Japan . |
| 217309 | 4/1990 | Japan . |

*Primary Examiner*—David H. Bollinger

*Attorney, Agent, or Firm*—Dennison, Meserole, Pollack & Scheiner

[57] ABSTRACT

A fastener feeding mechanism in a fastener driving device is provided for feeding fasteners from a fastener support rail formed in a magazine to a fastener drive track formed in a driver guide for reciprocal movement of a driver and connected to a forward portion of the fastener support rail. The fastener feeding mechanism includes an operation member operable by an operator and slidably movable in a longitudinal direction of the fastener support rail. A biasing mechanism biases the operation member in the forward direction of the fastener support rail. A pusher is movable in the longitudinal direction of the fastener support rail and includes an abutting portion for abutting on the rear end of a row of the fasteners. The abutting portion is movable between a first position within the fastener support rail and a second position away from the fastener support rail. An interlocking mechanism is provided between the operation member and the pusher for permitting movement of the pusher together with the operation member and for moving the pusher in such a manner that the abutting portion moves from the first position to the second position according to movement of the operation member in a rearward direction of the fastener support rail.

6 Claims, 3 Drawing Sheets

FASTENER FEEDING MECHANISM IN FASTENER DRIVING DEVICE

BACKGROUND OF THE INVENTION

1. Field of the Invention

The present invention relates to a fastener feeding mechanism for feeding fasteners from a fastener support rail formed in a magazine of a fastener driving device.

2. Description of the Prior Art

Japanese Utility Model Publication No. 55-28455 discloses a fastener driving mechanism in a fastener driving device. The fastener driving mechanism includes a slider and an engaging member. The slider is slidably movable relative to a magazine in a longitudinal direction of the magazine. The engaging member is pivotally mounted on the slider and includes an engaging portion for engagement with a row of fasteners disposed within a fastener support rail formed in the magazine in the longitudinal direction. The engaging member further includes a knob for operation by an operator with his hand. With this fastener driving mechanism, the loading operation of new fasteners into the fastener support rail is performed as follows:

Firstly, the operator moves the knob to pivot the engaging member in such a manner that the engaging portion moves away from the fastener support rail. Keeping the engaging portion in this position, the operator moves the slider rearward of the magazine. New fasteners are subsequently loaded into the fastener support rail from rear of the magazine. Upon releasing the knob and the slider, the engaging portion returns to the position for engagement with the fasteners and the slider is moved forward, so that the engaging portion abuts on the rear end of the row of the new fasteners.

Japanese Patent Publication No. 2-17309 discloses a fastener feeding mechanism having a feeder slidably mounted on a magazine in a longitudinal direction. A claw lever is pivotally mounted on the feeder and includes a claw for engagement with a shank of a fastener, and a pull for operation of the claw lever. The claw includes a cam surface for cooperation with the shank of the fastener. A protruding member is provided at the rear portion of the magazine for protruding into and retracting from a fastener support rail formed within the magazine. With this fastener driving mechanism, the loading operation of new fasteners into the fastener support rail is performed as follows:

Firstly, the protruding member is retracted from the fastener support rail to permit loading of the new fasteners. After completion of loading of the new fasteners, the protruding member is protruded to abut on the end of the row of the new fasteners. The feeder is thereafter moved to reach a position rearward of the new fasteners. As the feeder is thus moved, the claw lever is rotated through cooperation of the cam surface and the shank of the fastener which is disposed at a most forward position of the row of the new fasteners, so that the claw of the claw lever is moved away from the fastener support rail. When the feeder reaches the position rearward of the new fasteners, the claw lever returns to its position for engagement with the rear end of the row of the new fasteners.

However, with the former fastener feeding mechanism, the loading operation is very difficult because it involves two different steps, one for rotation of the engaging member to move the engaging portion away from the fastener support rail and another for moving the slider in the rearward direction while keeping the engaging member at the rotated position.

Further, with the latter fastener feeding mechanism, although the claw of the claw lever can be moved away from the fastener support rail through rotation of the claw lever according to the rearward movement of the feeder, it is necessary to provide the protruding member to engage the rear end of the row of the new fasteners so as to permit such rotation of the claw lever. Further, it is necessary to move the protruding member away from the fastener support rail for loading new fasteners again. Therefore, the loading operation is also difficult.

SUMMARY OF THE INVENTION

It is, accordingly, an object of the present invention to provide a fastener feeding mechanism in a fastener driving device which is easily operated.

It is another object of the present invention to provide a fastener feeding mechanism in a fastener driving device which permits fasteners to be easily loaded into a magazine.

According to the present invention, there is provided a fastener feeding mechanism in a fastener driving device for feeding fasteners from a fastener support rail formed in a magazine to a fastener drive track formed in a driver guide for reciprocal movement of a driver and connected to a forward portion of the fastener support rail, comprising:

an operation member operable by an operator and slidably movable in a longitudinal direction of the fastener support rail;

a biasing mechanism for biasing the operation member in the forward direction of the fastener support rail;

a pusher movable in the longitudinal direction of the fastener support rail and having an abutting portion for abutting on the rear end of a row of the fasteners; the abutting portion being movable between a first position within the fastener support rail and a second position away from the fastener support rail; and an interlocking mechanism provided between the operation member and the pusher for permitting movement of the pusher together with the operation member and for moving the pusher in such a manner that the abutting portion moves from the first position to the second position according to movement of the operation member in a rearward direction of the fastener support rail.

The invention will become more fully apparent from the claims and the description as it proceeds in connection with the drawings.

DETAILED DESCRIPTION OF THE PREFERRED EMBODIMENT

Figure 1:
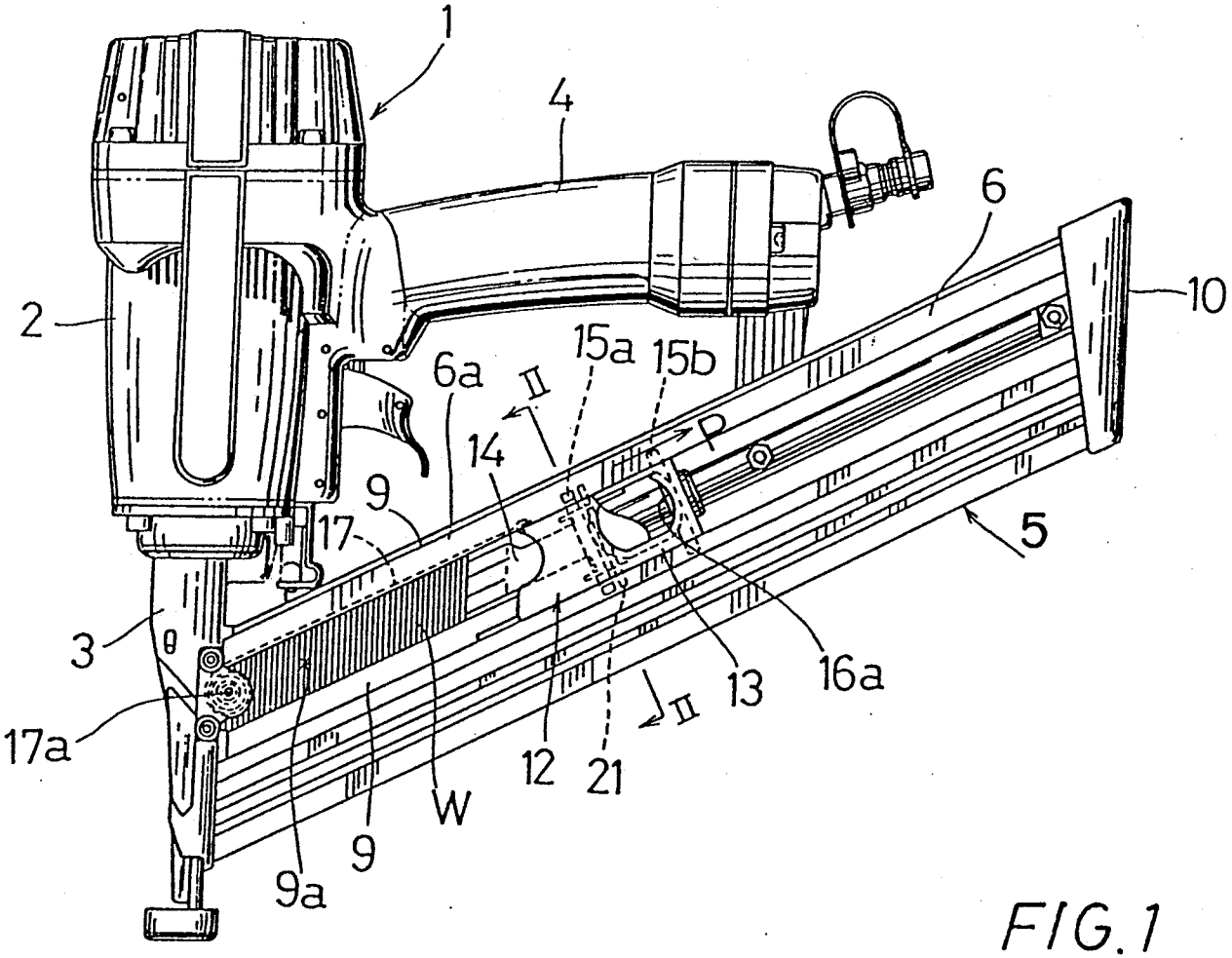
FIG. 1 is a side view of a fastener driving device including a fastener feeding mechanism according to an embodiment of the present invention.

Referring to FIG. 1, there is shown a fastener driving device i including a fastener feeding mechanism according to an embodiment of the present invention. The fastener driving device 1 is generally constructed to reciprocally move a piston through a compressed air supplied from an air source. The piston is connected to a driver so as to drive fasteners W one after another. The fasteners W may be nails, U-shaped staples, etc. and are connected in a row.

A body 2 accommodates the piston at its upper portion and includes a driver guide 3 at its lower portion. The driver guide 3 includes therein a fastener drive track which receives fasteners W supplied from a magazine 5 one after another and through which the driver is reciprocally moved to drive the fasteners W. A handle 4 is integrally formed with the body 2 and extends substantially perpendicular to the body 2 from the middle portion thereof. The magazine 5 is fixed to the driver guide 3 and to the handle 4 at its forward portion and substantially the middle portion, respectively, in such a manner that the magazine 5 extends obliquely relative to the driver guide 3.

The magazine 5 includes an elongated magazine body 6 having a fastener support rail 7 formed therein. The fastener support rail 7 is of a generally T-shaped configuration in section and extends throughout the magazine body 6 in a longitudinal direction. The forward end of the fastener support rail 7 is connected to the fastener drive track of the driver guide 3, while the rear end of the same functions as an inlet for loading the fasteners W.

Figure 2:
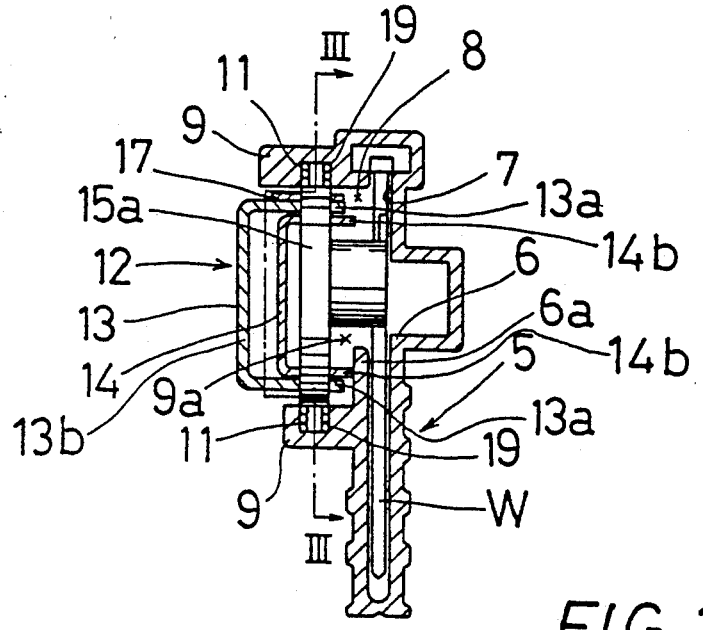
FIG. 2 is a sectional view taken along line II—II in FIG. 1.

As shown in FIG. 2, the magazine body 6 includes a side wall 6*a* having at its upper portion an opening 8 extending in a longitudinal direction of the magazine body 6. A pair of parallel protrusions 9 are formed along the upper and lower ends of the opening 8, respectively to form therebetween a space 9*a* corresponding to the opening 8. A cap 10 is detachably mounted on the rear end of the magazine body 6 so as to close the inlet of the fastener support rail (see FIG. 1).

A pair of guide channels 11 are formed on the inner surfaces of the protrusions 9 at positions opposed to each other. A fastener feeder 12 is movable within the space 9*a* in a longitudinal direction of the fastener support rail 7 along the guide channels 11.

The fastener feeder 12 includes an operation member 13 and a pusher 14. The operation member 13 has a pair of upper and lower portions 13*a* and a lateral portion 13*b* to form a generally C-shaped configuration in section and is operable by fingers of an operator. The pusher 14 is prepared for abutment on a rear end of the row of the fasteners W loaded in the fastener support rail 7.

Figure 3:
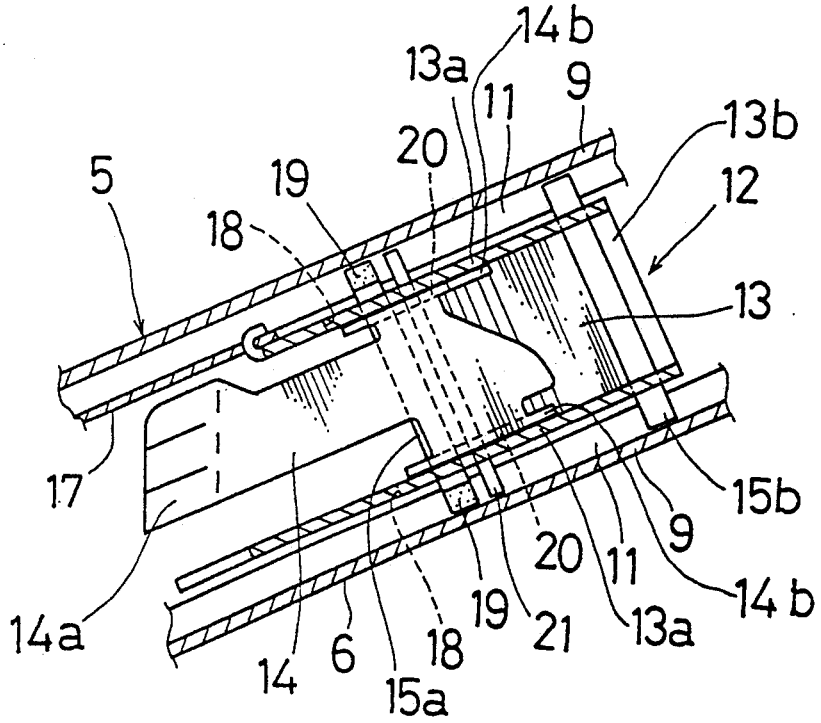
FIG. 3 is a sectional view taken along line III—III in FIG. 2.
Figure 4:
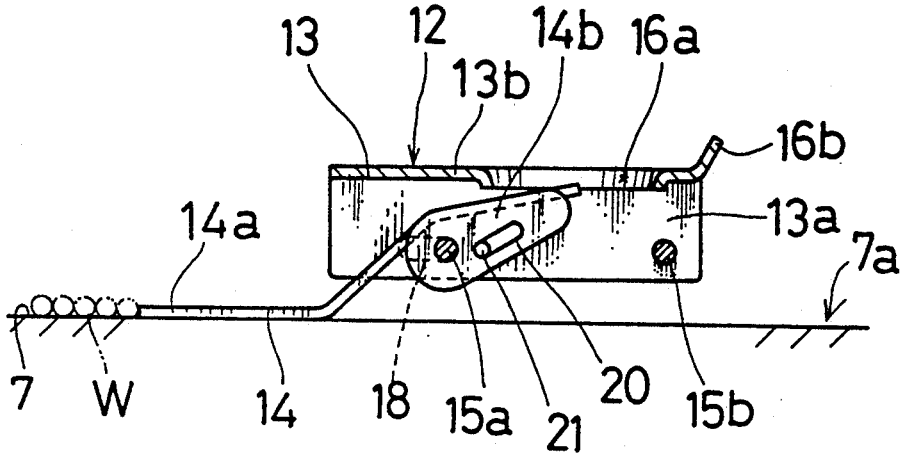
FIG. 4 is an explanatory view showing operation of the fastener feeding mechanism where the fasteners are pressed forwardly by a pusher of the fastener feeding mechanism.

As shown in FIGS. 1 and 2, a pair of support shafts 15*a*, 15*b* are inserted into the upper and lower portions 13*a* of the operation member 13 at the forward and rear sides thereof, respectively. The support shafts 15*a*, 15*b* extend in a direction perpendicular to the longitudinal direction of the fastener support rail 7 and protrude outwardly through the upper and lower portions 13*a* of the operation member 13 to engage the corresponding guide channels 11, respectively. Thus, the operation member 13 is slidably movable along the guide channels 11 relative to the magazine body 6. As shown in FIG. 4, the lateral portion 13*b* of the operation member 13 includes a hole 16*a* for inserting fingers of the operator and also includes an extension for engagement by the fingers. As shown in FIG. 3, the upper portion 13*a* of the operation member 13 is connected to one end of a power spring 17 extending along the inner surface of the upper protrusion 9. The other end of the power spring 17 is wound around a pin 17*a* mounted on a forward portion of the magazine body 6. Thus, the operation member 13 is biased by the power spring 17 toward the forward end of the magazine body 5.

The support shaft 15*a* is inserted into the upper and lower portions 13*a* of the operational member 13 through parallel elongated slots 18 extending in parallel with the guide channels 11, respectively. Bushes 19 are mounted on both ends of the support shaft 15*a* which engage the guide channels 11. The bushes 19 are made of urethane resin or the like which provide frictional resistance against the guide channels 11.

The pusher 14 includes a plate-like portion 14*a* bent like a crank configuration and a pair of upper and lower flange portions 14*b* integrally formed with the rear part of the plate-like portion 14*a*. The flange portions 14*b* extend in parallel with each other so as to form a generally C-shaped configuration together with the rear part of the plate-like portion 14*a*. The flange portions 14*b* are rotatably mounted on the support shaft 15*a* in such a manner that the forward part of the plate-like portion 14*a* abuts on a lateral wall 7*a* of the fastener support rail 7 in parallel therewith as shown in FIG. 4. Each of the flanged portions 14*b* includes an oblique elongated slot 20 positioned rearwardly of the mounting portion of the support shaft 15*a*. The oblique elongated slot 20 extends away from the lateral wall 7*a* of the fastener support rail 7 in the rearward direction. A cam shaft 21 extends through the oblique elongated slots 20. Both ends of the cam shaft 21 are inserted into the upper and lower portions 13*a* of the operation member 13 and are engaged with the guide channels 11 in such a manner that the cam shaft 21 is movable together with the operation member 13 along the guide channels 11. Thus, the pusher 14 is pivoted around the support shaft 15*a* according to movement of engaging position of the cam shaft 21 with the oblique elongated slots 20. The relation between the engaging position of the support shaft 15*a* with the parallel elongated slots 18 of the operation member 13 and the engaging position of the cam shaft 11 with the oblique elongated slots 20 is determined as follows:

a) The support shaft 15*a* engages the rear ends of the parallel elongated slots 18 while the cam shaft 21 engages the forward ends of the oblique elongated slots 20 when the forward portion of the plate-like portion 14*a* of the pusher 14 abuts on the lateral wall 7*a* of the fastener support rail 7 or the forward portion is positioned within the fastener support rail 7 for abutment on the fasteners W as shown in FIG. 4.

b) The support shaft 15*a* engages the forward ends of the parallel elongated slots 18 while the cam shaft 21 engages the rear ends of the oblique elongated slots 20 when the forward portion of the plate-like portion 14*a* of the pusher 14 is moved away from the fastener support rail 7.

The operation of the above embodiment will now be explained.

At the stage shown in FIG. 4, the forward portion of the plate-like portion 14*a* of the pusher 14 is positioned within the fastener support rail 7 as described above and abuts on the rear end of the row of the fasteners W loaded within the fastener support rail 7. Since the operation member 13 is biased by the power spring 17 in the forward direction of the magazine body 6, the fasteners W are pressed by the pusher 14 in a direction toward the fastener drive track of the driver guide 3. Thus, the fasteners W can be fed into the fastener drive track and can be driven one after another according to the movement of the driver.

When all of the fasteners W have been fed from the fastener support rail 7, a predetermined number of new fasteners W connected in a row are loaded into the fastener support rail 7 through the inlet of the magazine body 6. At this stage, since the forward portion of the pusher 14 is positioned within the fastener support rail 7, the new fasteners W abut on the bent portion formed rearwardly of the forward portion of the pusher 14 and cannot be moved further.

Figure 5:
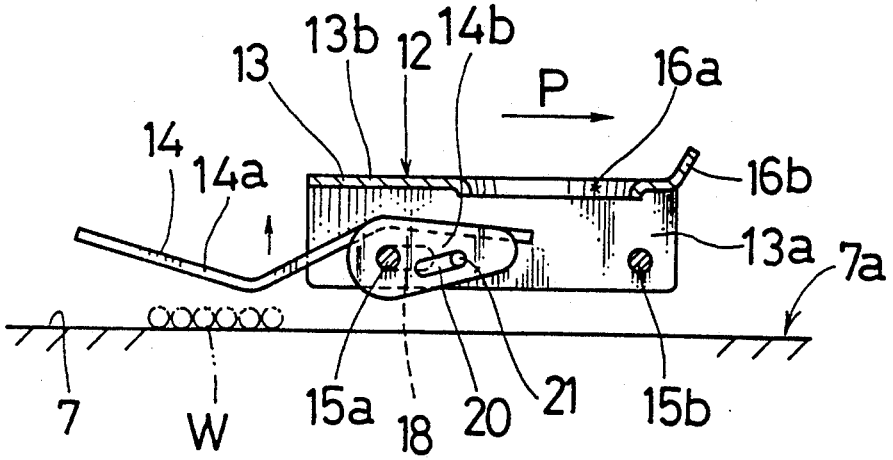
FIG. 5 is a view similar to FIG. 4 but showing a different operation where the pusher is moved away from a fastener support rail.

The operator then moves the operation member 13 of the fastener feeder 12 in the rearward direction as shown in FIGS. 1 and 5 by an arrow P. At the beginning of such movement of the operation member 13, the support shaft 15*a* does not move together with the operation member 13 because of existence of the parallel elongated slots 18 and is prevented from moving through frictional force between the bushes 19 and the guide channels 11 until the operation member 13 is moved by a distance corresponding to the length of the parallel elongated slots 18. Thus, the pusher 14 is prevented from moving in the longitudinal direction of the magazine body 6 but is pivoted around the support shaft 15*a* through movement of the engaging position of the cam shaft 21 with the oblique elongated slots 20 away from the fastener support rail 7 since the cam shaft 21 is moved together with the operation member 13. The forward portion 14 of the pusher 14 is therefore retracted from the fastener support rail 7, so that the new fasteners W can be moved further in the forward direction.

After the operation member 13 is moved by the distance corresponding to the length of the parallel elongated slots 18, the pusher 14 is moved together with the operation member 13 while keeping the forward portion of the plate-like portion 14*a* at the retracted position.

The operational member 13 is further moved rearwardly until the forward portion passes over the rear end of the row of the new fasteners W. The operation member 13 is then released to be returned by the biasing force of the power spring 17. At the beginning of the return movement of the operation member 13, the pusher 14 does not move together with the operation member 13 until the operation member 13 is returned by the distance corresponding to the length of the parallel elongated slots 18 for the same reason as described above. Thus, the pusher 14 is pivoted around the support shaft 15*a* to position the forward portion of the plate-like portion 14*a* within the fastener support rail 7, and the forward portion of the plate-like portion 14*a* abuts on the rear end of the row of new fasteners W to force the new fasteners forward. The pusher 14 thus pivoted is prevented from moving by the biasing force of the power spring 17 in connection with the engaging position of the cam shaft 21 with the oblique elongated slots 20 relative to the position of the support shaft 15.

In the operation as described above, the new fasteners W can be loaded after the operation member 13 has been moved rearwardly to permit loading of the new fasteners W.

While the invention has been described with reference to a preferred embodiment thereof, it is to be understood that modifications or variations may be easily made without departing from the scope of the present invention which is defined by the appended claims.

What is claimed is:

1. A fastener feeding mechanism in a fastener driving device for feeding fasteners from a fastener support rail formed in a magazine to a fastener drive track formed in a driver guide for reciprocal movement of a driver and connected to a forward portion of the fastener guide rail, comprising:

an operation member operable by an operator and slidably movable in a longitudinal direction of the fastener support rail;

biasing means for biasing said operation member in the forward direction of the fastener support rail;

a pusher movable in the longitudinal direction of the fastener support rail and having an abutting portion for abutting on the rear end of a row of the fasteners; said abutting portion being movable between a first position within the fastener support rail and a second position away from the fastener support rail; and an interlocking means provided between said operation member and said pusher for permitting movement of said pusher together with said operation member and for moving said pusher in such a manner that said abutting portion moves form said first position to said second position according to movement of said operation member in a rearward direction of the fastener support rail, wherein said interlocking means includes a connecting mechanism and a guide mechanism; said connecting mechanism connects said pusher to said operation member in such a manner that said pusher is pivotable relative to said operation member and is movable relative thereto by a predetermined distance in the longitudinal direction of the fastener support rail; and said guide mechanism moves said pusher from said first position to said second position through pivotal movement of said pusher according to movement of said operation member relative to said pusher in the rearward direction.

2. The fastener feeding mechanism as defined in claim 1 wherein said connecting mechanism includes a first shaft mounted on one of said operation member and said pusher, and a first slot formed in the other of the same in the longitudinal direction of the fastener guide rail; said guide mechanism includes a second shaft mounted on one of said operation member and said pusher, and a second slot formed in the other of the same and extending obliquely relative to the longitudinal direction of the fastener support rail.

3. The fastener feeding mechanism as defined in claim 2 wherein said guide mechanism cooperates with said biasing means in such a manner that said pusher is normally biased toward said first position through said guide mechanism.

4. The fastener feeding mechanism as defined in claim 3 wherein said guide mechanism is disposed rearwardly of said connecting mechanism; said second shaft is mounted on said operational member; said second slot is formed in said pusher and extends away from the fastener support rail in the rearward direction; said second shaft engages the forward end of said second slot when said pusher is positioned at said first position.

5. The fastener feeding mechanism as defined in claim 4 wherein said first shaft is mounted on said pusher and is slidably movable in the longitudinal direction along the guide channel formed in the magazine; a first recess is formed in said operation member; said first shaft engages the rear end of said first slot by the biasing force of said biasing means when said pusher is positioned at said first position and said pusher abuts on the rear end of the row of the fasteners; and said first shaft engages the forward end of said first slot when said pusher is positioned at said second position.

6. The fastener feeding mechanism as defined in claim 5 wherein said guide mechanism includes a pair of guide channels and said first shaft is frictionally engaged with the guide channels.

* * * * *